US010600288B2

(12) United States Patent
Berman et al.

(10) Patent No.: US 10,600,288 B2
(45) Date of Patent: Mar. 24, 2020

(54) EXTENDED DISPLAY OF GAME INDICIA SYMBOLS FOR GAMING APPARATUSES

(71) Applicant: KING SHOW GAMES, INC., Minnetonka, MN (US)

(72) Inventors: Bradley Berman, Minnetonka, MN (US); Chad Shapiro, Plymouth, MN (US); Ryan Strand, Hopkins, MN (US)

( * ) Notice: Subject to any disclaimer, the term of this patent is extended or adjusted under 35 U.S.C. 154(b) by 373 days.

(21) Appl. No.: 14/177,636

(22) Filed: Feb. 11, 2014

(65) Prior Publication Data

US 2014/0228091 A1 Aug. 14, 2014

Related U.S. Application Data

(60) Provisional application No. 61/763,436, filed on Feb. 11, 2013.

(51) Int. Cl.
*G07F 17/32* (2006.01)
*G07F 17/34* (2006.01)

(52) U.S. Cl.
CPC ..... *G07F 17/34* (2013.01); *G07F 17/3244* (2013.01)

(58) Field of Classification Search
CPC ..... G07F 17/34; G07F 17/3267; G07F 17/32; G07F 17/3244
USPC ..... 463/20
See application file for complete search history.

(56) References Cited

U.S. PATENT DOCUMENTS 6,135,884 A * 10/2000 Hedrick ..... G07F 17/3211 273/143 R
6,722,976 B2 * 4/2004 Adams ..... A63F 9/24 463/16
8,016,661 B2 * 9/2011 Yoshizawa ..... G07F 17/32 463/20
8,535,141 B2 * 9/2013 Rommerdahl ..... G07F 17/3209 463/16
8,834,259 B2 * 9/2014 Rommerdahl ..... G07F 17/3209 463/16
2003/0153385 A1 * 8/2003 Ikeya ..... G07F 17/32 463/31
2004/0140618 A1 * 7/2004 Fox ..... G07F 17/34 273/292
2006/0116187 A1 * 6/2006 Johnson ..... G07F 17/3211 463/16
2007/0155511 A1 * 7/2007 Grundstedt ..... G07F 17/32 463/46
2008/0045314 A1 * 2/2008 Okada ..... G07F 17/3267 463/20
2009/0124345 A1 * 5/2009 Gilmore ..... G07F 17/32 463/20
2010/0004049 A1 * 1/2010 Ching ..... G07F 17/3267 463/20
2011/0105218 A1 * 5/2011 Anderson ..... G07F 17/32 463/20

(Continued)

*Primary Examiner* — Milap Shah

(57) ABSTRACT

Embodiments of the present invention set forth systems, apparatuses and methods for providing an extended display of game indicia symbols for a gaming device. Accordingly, a gaming device can be configured to have a primary display area and a secondary display area, where the secondary display area is used to show extended portions of game indicia symbols apart from the symbols displayed on the primary display area. The symbols shown in the secondary game may be used to modify, enhance, or otherwise influence game play on the primary display.

9 Claims, 15 Drawing Sheets

(56) References Cited

U.S. PATENT DOCUMENTS

| | | | | |
|---|---|---|---|---|
| 2011/0306402 | A1* | 12/2011 | Van Linden | G07F 17/3213 463/20 |
| 2012/0122545 | A1* | 5/2012 | Watkins | G07F 17/3211 463/20 |
| 2013/0122988 | A1* | 5/2013 | Guinn | A63F 13/00 463/20 |
| 2014/0094249 | A1* | 4/2014 | Gugler | G07F 17/34 463/20 |

* cited by examiner

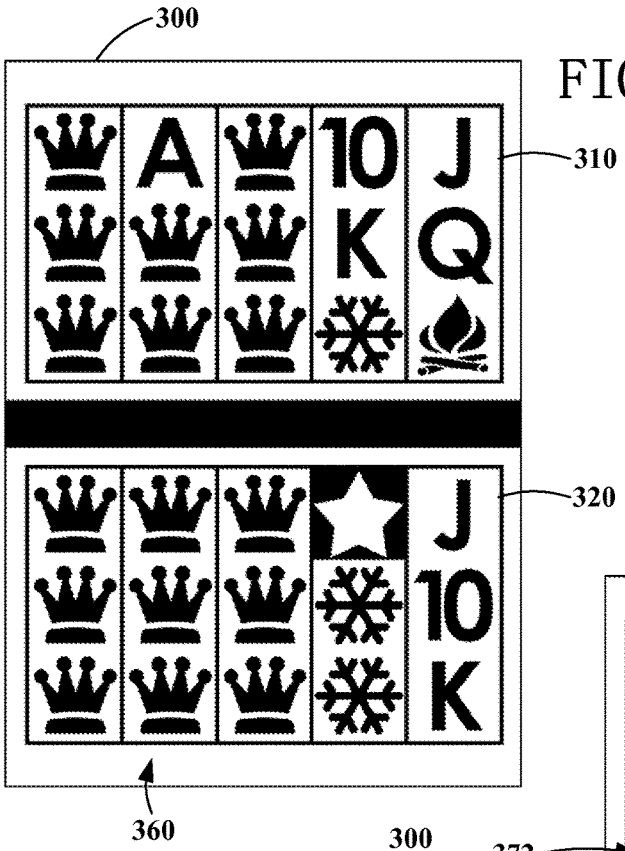
FIG. 3A
FIG. 3B
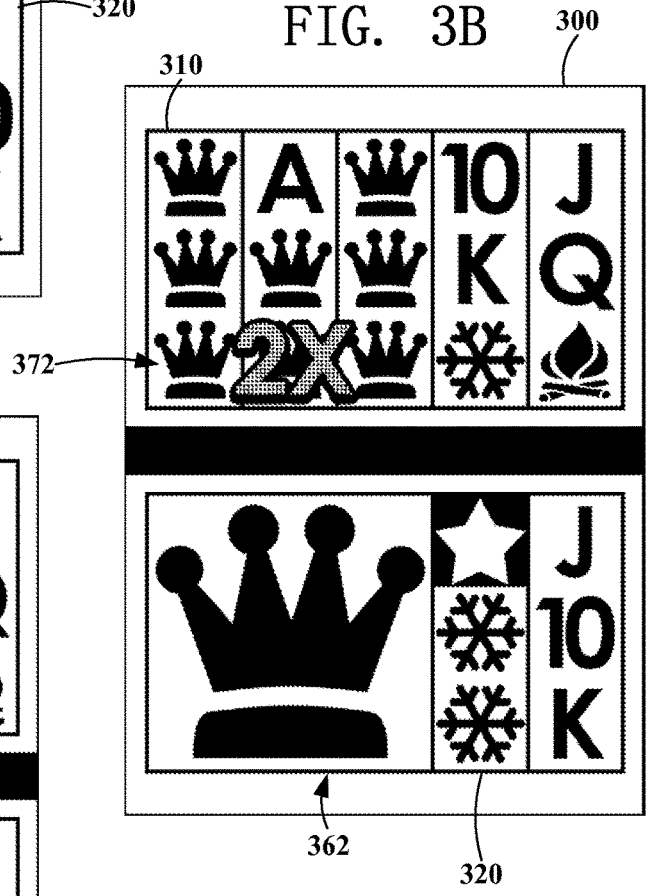
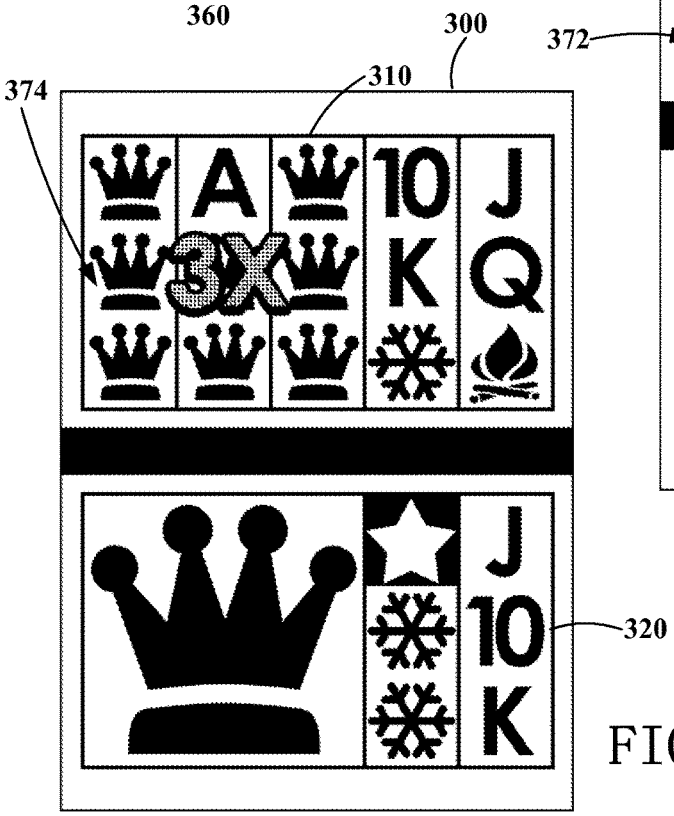
FIG. 3C

EXTENDED DISPLAY OF GAME INDICIA SYMBOLS FOR GAMING APPARATUSES

RELATED APPLICATIONS

This application claims the benefit of Provisional Patent Application No. 61/763,436, filed on Feb. 11, 2013, to which priority is claimed pursuant to 35 U.S.C. § 119(e) and which is incorporated herein by reference in its entirety.

FIELD OF THE INVENTION

This disclosure relates generally to wagering games, and more particularly to wagering games played on gaming apparatuses where the wagering game includes an extended display of game indicia symbols.

BACKGROUND

Casino games such as poker, slots, and craps have long been enjoyed as a means of entertainment. Almost any game of chance that can be played using traditional apparatus (e.g., cards, dice) can be simulated on a computer. The popularity of casino gambling with wagering continues to increase, as does recreational gambling such as non-wagering computer game gambling. It is also likely that most new games will be implemented, at least in part, using computerized apparatus.

One reason that casino games are widely implemented on computerized apparatus is that computerized games are highly adaptable, easily configurable and re-configurable, and require minimal supervision to operate. For example, the graphics and sounds included in such games can be easily modified to reflect popular subjects, such as movies and television shows.

Computer gaming devices can also be easily adapted to provide entirely new games of chance that might be difficult to implement using mechanical or discrete electronic circuits. Because of the ubiquity of computerized gaming machines, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill. In some jurisdictions, the absence of skill when determining awards during game play is a requirement.

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, the present invention is directed to an apparatus, system, computer readable storage media, and/or method that involve or otherwise facilitate providing extended displays of game indicia symbols (also referred to as markings) outside of a main game play area. In one embodiment, a method includes displaying symbols in a main game play area and in a secondary area, where the symbols in the main play area are evaluated to determine game outcomes, and the symbols in the secondary area are evaluated to determine if a bonus event is triggered. The bonus event may impact the evaluation of the symbols in the main game play area or may provide an independent bonus event. The symbols in the secondary area may be related or associated with the symbols in the primary game area. In some embodiments, the secondary area is displayed directly above the main game display where the symbols in the secondary area are on the same reel strips as those shown in the main display area.

BRIEF DESCRIPTION OF THE DRAWINGS

FIGS. 3A, 3B, and 3C are diagrams of a game display showing example game play methods according to embodiments of the invention.

DETAILED DESCRIPTION

Figure 1A:
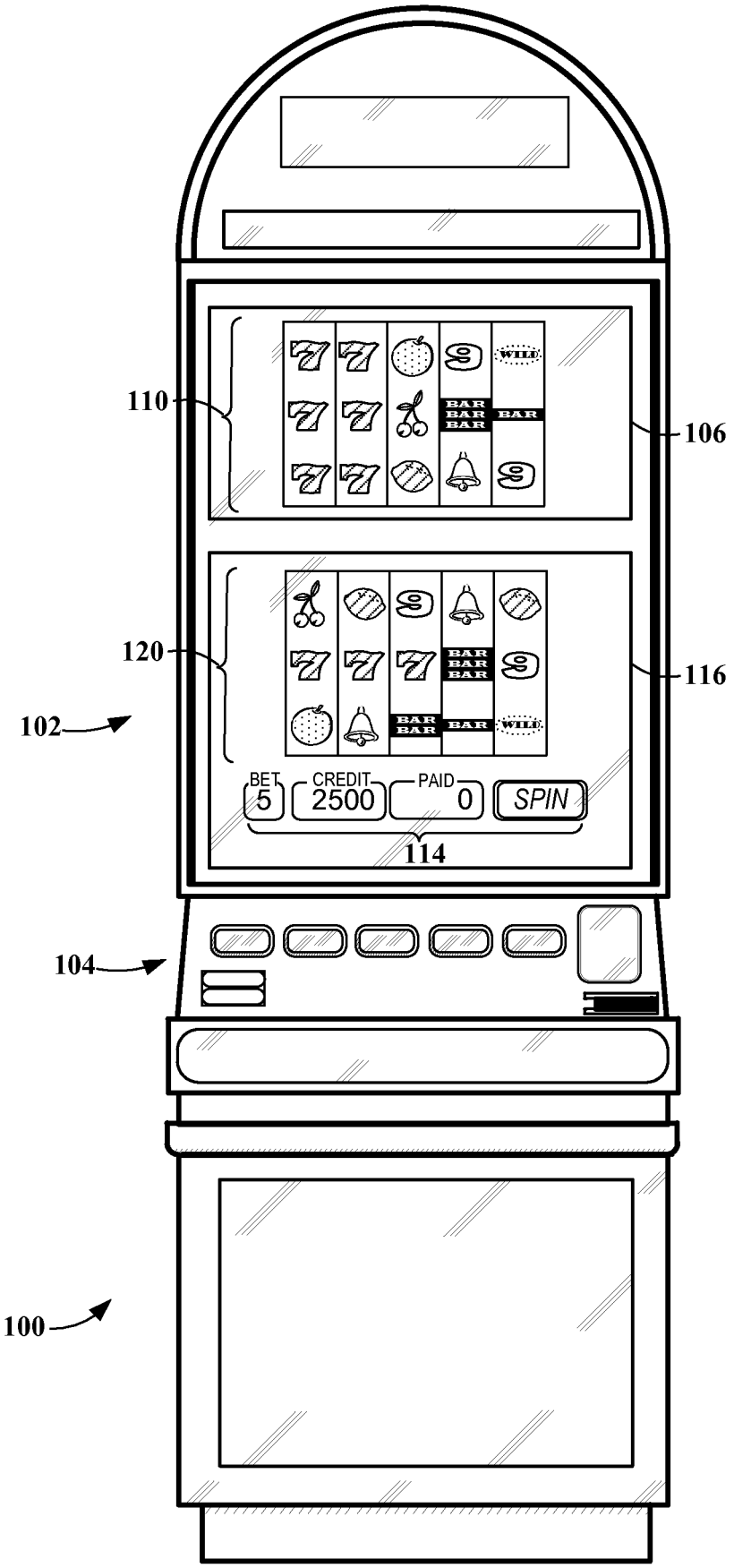
FIGS. 1A and 1B are diagrams of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the term "reels," "cards," "decks," and similar mechanically descriptive language may be used to describe various apparatus presentation features, as well as various actions occurring to those object (e.g., "spin," "draw," "hold," "bet"). Although the present disclosure may be applicable to both to manual, mechanical, and computerized embodiments, and any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for providing extended displays of game indicia symbols in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. video slot machines) are provided for purposes of facilitating an understanding of the features described herein. However, the principles described herein are equally applicable to any game of chance where an outcome(s) is determined for use in the player's gaming activity. The game features described herein may be employed in stand-alone games, a primary/base games, bonus games, side bet games, etc.

Embodiments of the present concept include providing extended display indicia symbols for game play on a gaming apparatus (gaming device). In one embodiment, these extended display indicia may include extended parts of reel strips that are above the portions of the reels strips that land or stop in a main game display area. These extended parts of the reels strips may be used in triggering bonus events that may affect game play in the main game display area or provide an independent bonus event. By providing these extended display areas, the game may generate more anticipation and player enthusiasm as the player can see symbols that were close to making it in the main play area, as well as providing a multitude of bonus options utilizing the extended reel strips.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of extended displays of game indicia symbols in other types of gaming devices, such as mechanical slot games, video poker games, or other games of chance. Some of these other types of embodiments will be discussed below as variations to the examples illustrated. However, many other types of games can implement similar techniques and fall within the scope of this inventive concept.

Figure 1B:
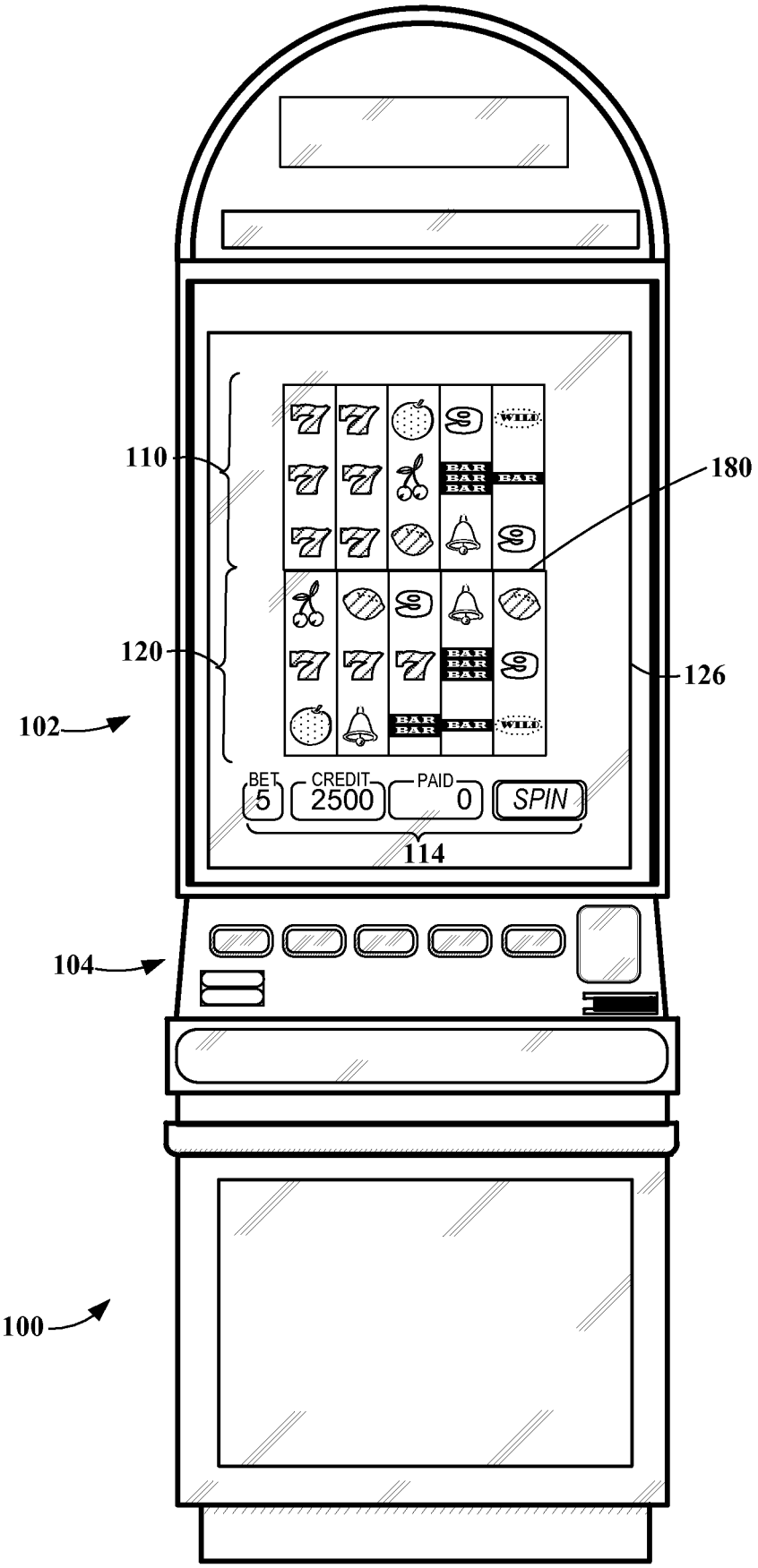

Representative embodiments for gaming devices including extended displays of game indicia symbols are shown in FIGS. 1A and 1B. Referring to the example gaming device 100 shown in FIGS. 1A and 1B, the gaming device includes a display portion 102 (also referred to as a gaming display), and a player interface portion 104, although some or all of the user interface 104 may be provided via the display 102 in touch screen embodiments. The display portion 102 may include one or more display areas 106, 116, 126 that may be included in physically separate displays (such as 106 and 116 in FIG. 1A) or as portions of a common large display (such as 126 in FIG. 1B).

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are known in the art. For example, coin/symbol input mechanisms, card readers, credit card readers, smart card readers, punch card readers, radio frequency identifier (RFID) readers, and other mechanisms may be used to enter wagers. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The display device 102 may include one or more of an electronic display, a mechanical display, and a fixed display information, such as paytable information associated with a glass/plastic panel on the gaming machine 100. The symbols or other indicia associated with the play of the game may be presented on an electronic display device or on mechanical devices associated with a mechanical display. In FIG. 1A, a primary game display 116 may display a grid of game symbols that form a primary game portion 120. A secondary game display 106 may display a grid showing an extended portion of the game symbols from the primary game portion 120 in a secondary game portion 110. Generally, the display 102 devotes the largest portion of viewable area to the primary gaming portion 116. However, in other embodiments, the secondary game display 106 may be of equal or greater size than the primary game display 116. The primary gaming display 116 is generally where the visual feedback for any selected game is provided to the user. The display device 102 may render graphical objects such as cards, slot reels, dice, animated characters, and any other gaming visual known in the art. The display device 102 also typically informs players of the outcome of any particular event, including whether the event resulted in a win or loss.

Here, a main game area 116 may display symbols 120 that are evaluated along paylines or other methods to determine if any symbol combinations or other criterion is received that is associated with a player award. A secondary display area 106 may display symbols 110 that are just above the symbols 120 displayed in the main game area 116. In some embodiments, the symbols 110 in the secondary display area 106 are the symbols that follow the symbols 116 shown in the main game area 120 along common reel strips. Thus, a player may observe how close they were in receiving other symbols needed for larger or different symbol combinations in the main game area 116. The additional symbols 110 in the secondary display area 106 may be used to in determining whether a bonus event has been triggered. A triggered bonus event may impact the game play in the main game display area 116, or may provide an award opportunity or other bonus event independently of the game play in the main game area 116.

As shown in FIG. 1B, a single game display 126 may be used instead of multiple game displays to show both the primary game portion 116 and secondary game portion 106. In embodiments that feature a single game display 126, a partition 180 or other indicator may be used to visually separate the primary game portion 120 from the secondary game portion 110. This partition 180 may be visual separation between the grids of the primary and secondary game portions 120, 110, a visual partition such as a bar or other feature separating the primary and secondary game portions, or a change in structuring of the primary and secondary game portions such as a dimensional or orientation of one of the primary or secondary game portions. However, in other embodiments having a single game display 126, the primary game portion 116 may be connected to the secondary game portion 106 without a partition or other indication that the game portions are separate for purposes of pay evaluations or other game functions.

The display device 102 may include other features known in the art that facilitate gaming, such as status and control portion 114. As is generally known in the art, this portion 114 provides information about current bets, current wins, remaining credits, etc. associated with gaming activities of the primary game portion 120. The control portion 114 may also provide touchscreen controls for facilitating game play. The primary and secondary game portions 120, 110 may also include touchscreen features. One or both of the primary and secondary game displays 116, 106 (or game display 126) may also include other features that are not shown, such as paytables, navigation controls, etc.

Figure 2A:
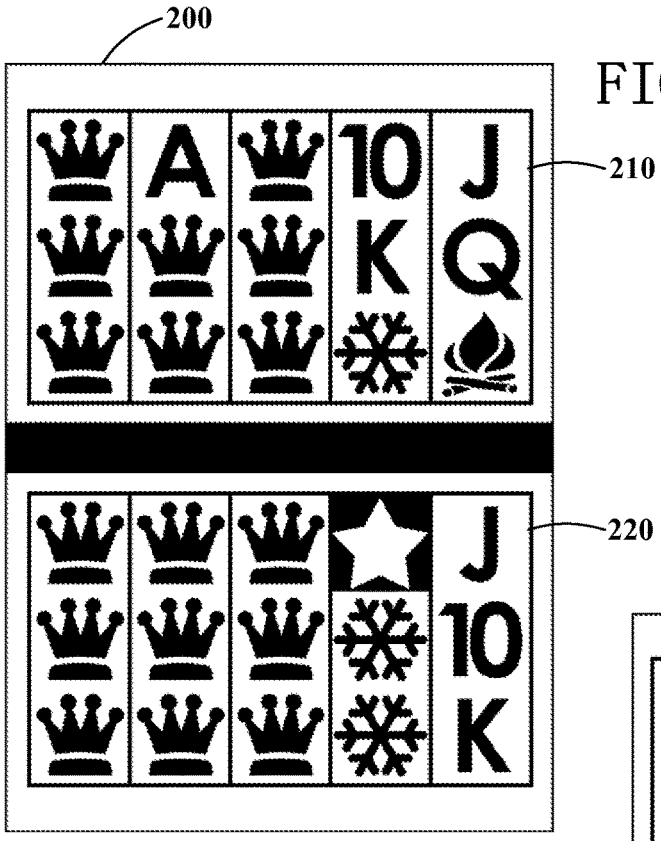
FIGS. 2A, 2B, and 2C are diagrams of example game displays according to embodiments of the invention.
Figure 2B:
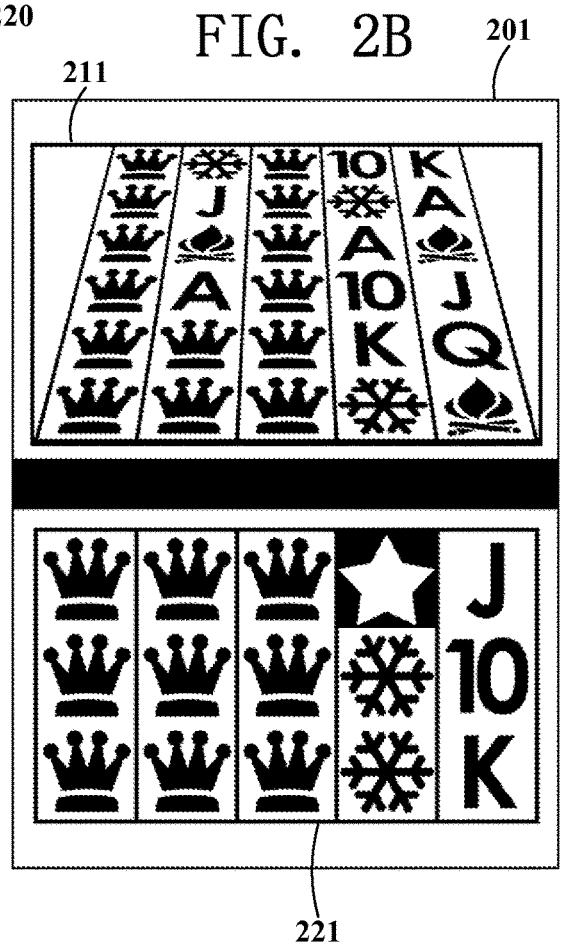
Figure 2C:
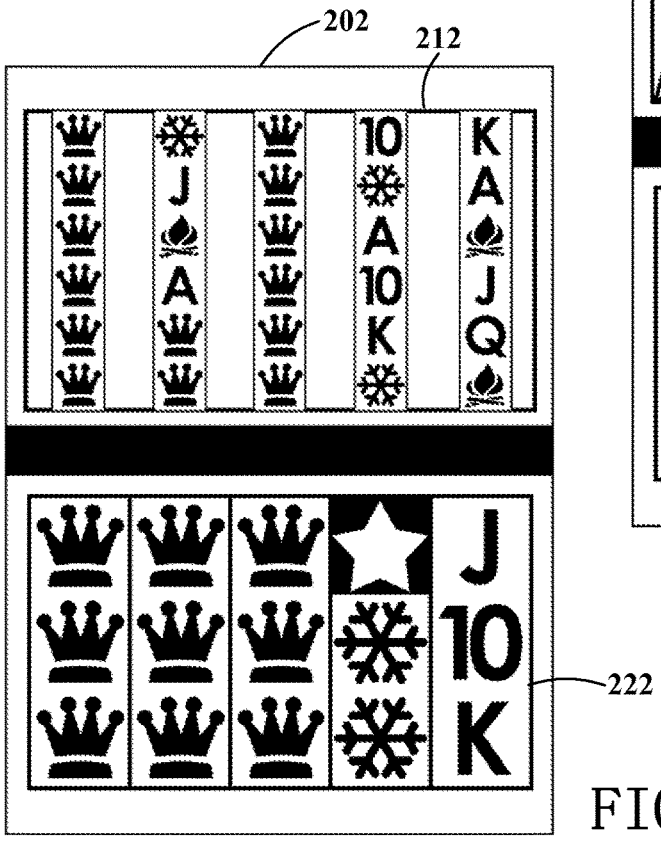

FIGS. 2A, 2B, and 2C are diagrams of example game displays according to embodiments of the invention.

Referring to FIG. 2A, a game display 200 includes a primary game portion or display 220 and a secondary game portion or display 210. In this embodiment, the secondary game portion 210 is positioned above the primary game portion 220 and shows an extended view of game reels that pass through the primary game portion. In FIG. 2A, this extension of the game reels shown in the secondary game display 210 are of substantially the same size and orientation as the game reels shown in the primary game display 220.

In other embodiments, however, the size, orientation, or other characteristic of the extended game reels shown in the secondary game portion 210 may be different from how the game reels are shown in the primary game portion 220. For example, the embodiment shown in FIG. 2B illustrates a game display 201 where the reel strips are oriented in a reclined manner in the secondary game portion 211, as compared to the display of the reels in the primary game portion 221. The embodiment shown in FIG. 2B may visually differentiate the primary and secondary game portions, and may give the reels a three-dimensional feel. In FIG. 2C, another embodiment is shown where a game display 202 includes game reels that are sized differently in a secondary game portion 212 as compared to how the game reels are displayed in a primary game portion 222. Again this, difference in size may provide a visual differentiation between the primary and secondary game portions 222, 212 as well as providing a display of more of the symbols in the reel strip in the secondary game portion in a display area that is similar in size to that of the primary game portion.

In these embodiments (and other similar embodiments), the secondary or top display 210 may be a digital glass display that shows additional symbols above the primary or main game's reel area 220, in the form of extended reel strips. These additional symbols may represent the next symbols on the reel strips although they may not be part of the main game or any standard wins (such as evaluation of symbol combinations along paylines, etc. in the primary game portion 220). Any number of additional symbols may be displayed above (or below) the main or primary game display 220. The number of additional symbols shown in the secondary or extended display 210 may be of any number, from a single row of extra symbols, to many rows of additional symbols. Further, the number of displayed extra symbols may be variable.

The symbols in the secondary or extended display 210 may further cause bonus events to occur. These bonus events may affect the game play on the primary or main game 220, or may provide an independent bonus event. The following examples show some of the possible embodiments of how the symbols in the secondary display 210 might trigger bonus events that act upon the game play in the main game 220. In one example, a gaming device utilizing this extended display of game symbols could incorporate "Cascading Reels" where symbols wins disappear from the main game's reels 220 (when involved in a win or for other reasons) and the additional symbols fall down to fill the gaps from the secondary display 210.

In other embodiments, the additional symbols in the secondary display 220 may contribute to the main game 210 in the form of a Total Win Multiplier, a Multiplier toward a specific symbol's win, credit award(s), Bonus Initiation, Reel-nudging, Progressive Award, or any other positive outcome when they land in specific configurations. FIGS. 3A-3C, 4A-4C, 5A-5C, 6A-6B, 7A-7C, and 8A-8F are diagrams of game displays that show some of these example game play methods according to embodiments of the invention. Although some embodiments are illustrated in this figures, many other embodiments and/or variations are possible following the same inventive principles.

Referring to FIGS. 3A-3C, a game display 300 includes a primary game portion or display 320 and a secondary game portion or display 310. In this embodiment, if one or more winning symbol combinations 360 occur in the primary game display 320, the matching symbol combinations for the primary award combination in the secondary display 310 provide a win multiplier for the winning symbol combination in the primary game portion 320. In another embodiment, when the award combination 360 in the primary game display 320 is a combination of similar stacked symbols (that may generate a large symbol 362 in a win animation as shown in FIGS. 3B and 3C), additional rows of that particular symbol in the secondary game portion 310 generate a win multiplier (or other award). As shown in FIG. 3A, three sets of stacked "crown" symbols 360 appear in the primary game display 320. The sets of stack "crown" symbols turn into a large crown symbol 362 (FIG. 3B) in the primary game display 320, and the secondary game portion 310 is analyzed for additional rows of at least three crown symbols. As shown in FIG. 3B, a first row of crowns 372 in the secondary display 310 generates a win multiplier of "2×" and, as shown in FIG. 3C, a second row of crowns 374 in the secondary display 310 generates a win multiplier of "3×." In some embodiments, only the highest received win multiplier is used to multiply wins associated with the primary game portion 320, while in other embodiments, each generated win multiplier is used to multiply wins in the primary game portion 320. In still other embodiments, multiple win multipliers received may be summed or multiplied together to form a larger win multiplier to multiply awards associated with wins in the primary game portion 320. In other embodiments, multipliers (or other awards) could be awarded for numbers of lines/ways of like symbols (symbol combinations) on the extended reels in the secondary display 310.

Figure 4A:
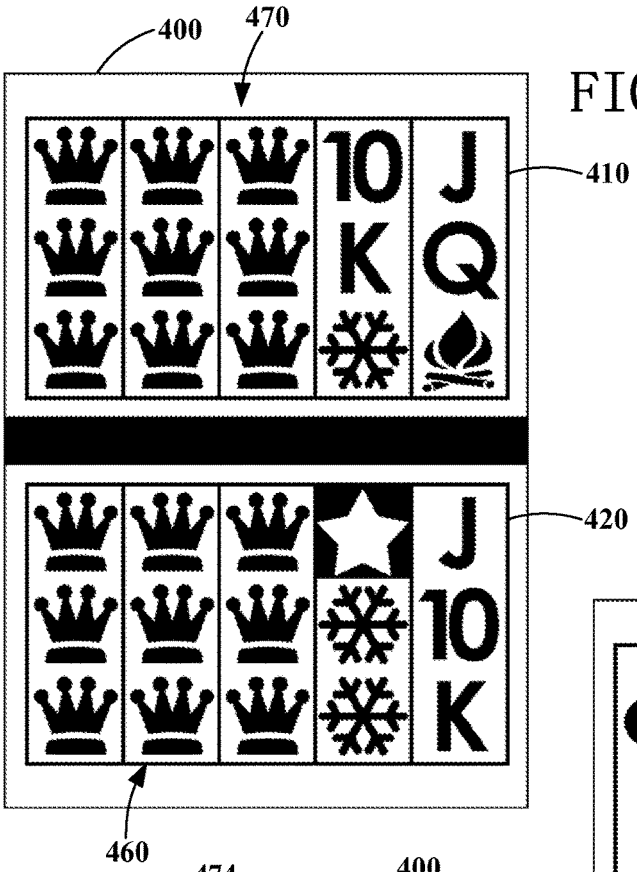
FIGS. 4A, 4B, and 4C are diagrams of a game display showing example game play methods according to embodiments of the invention.
Figure 4B:
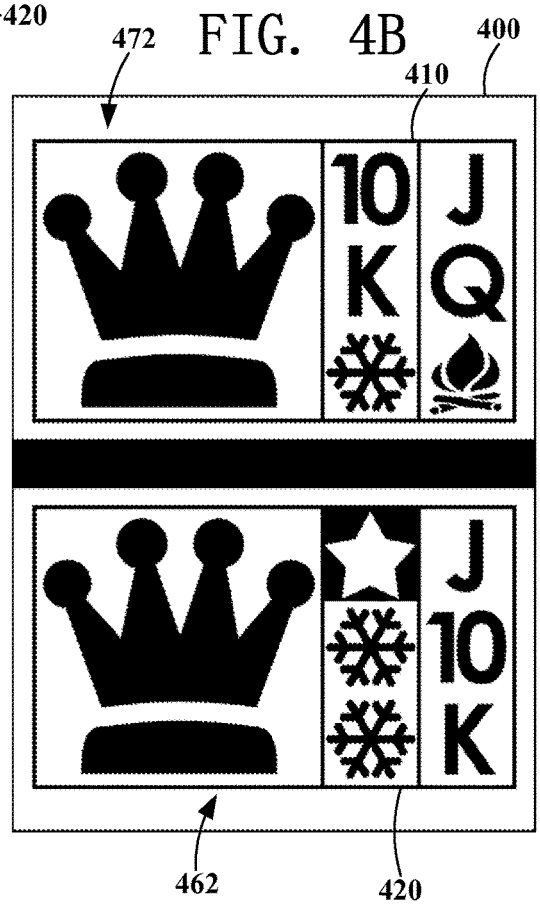
Figure 4C:
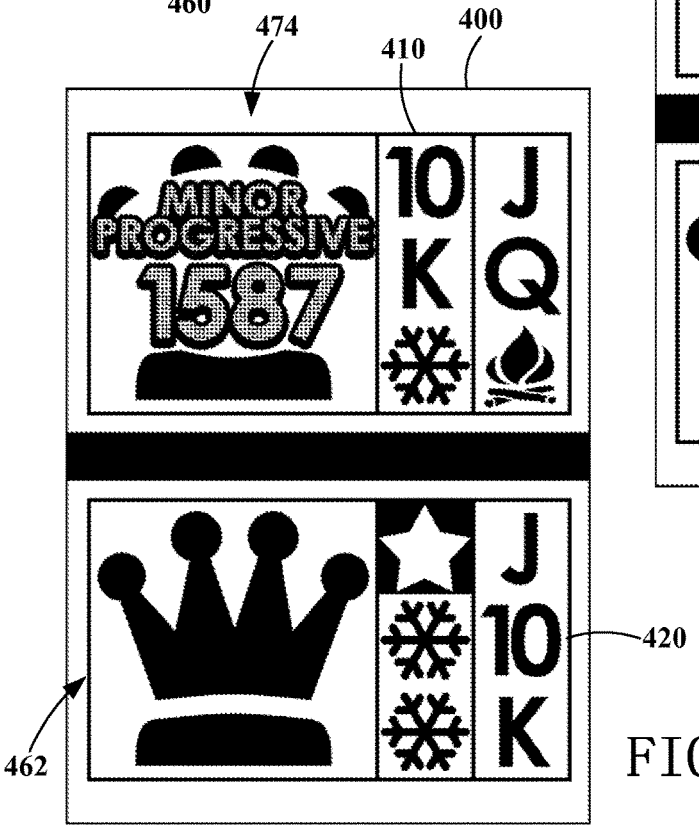

Referring to FIGS. 4A-4C, a game display 400 includes a primary game portion or display 420 and a secondary game portion or display 410. Here, if a group of stacked symbols 460 appear in a primary game display 420, and a similar or corresponding group of stacked symbols 470 appear in the secondary display 410, the gaming device may award a special bonus award, such as progressive (or other) award. As shown in FIG. 4A-4C, a group of stacked "crown" symbols 460 in the primary game portion 420 form a large block "crown" symbol 462, and a group of stacked "crown" symbols 470 in the secondary game portion 410 form another large block "crown" symbol 472. When two corresponding large block symbols 462, 472, a progressive award 474 is presented to the player. In this instance, since the block of stacked symbols was only 3 reel strips wide, a minor progressive is presented. Blocks of stacked symbols 4 reel strips wide may pay a major progressive award, while blocks of stacked symbols covering all 5 reel strips may pay a super or top progressive award. Note that in some embodiments, any group of additional symbols that appear together in a block of x symbols high by y reels wide in the secondary display 410 that also matches a complete block of symbols on the primary or main game 420 may award a Progressive (or other) award.

Figure 5A:
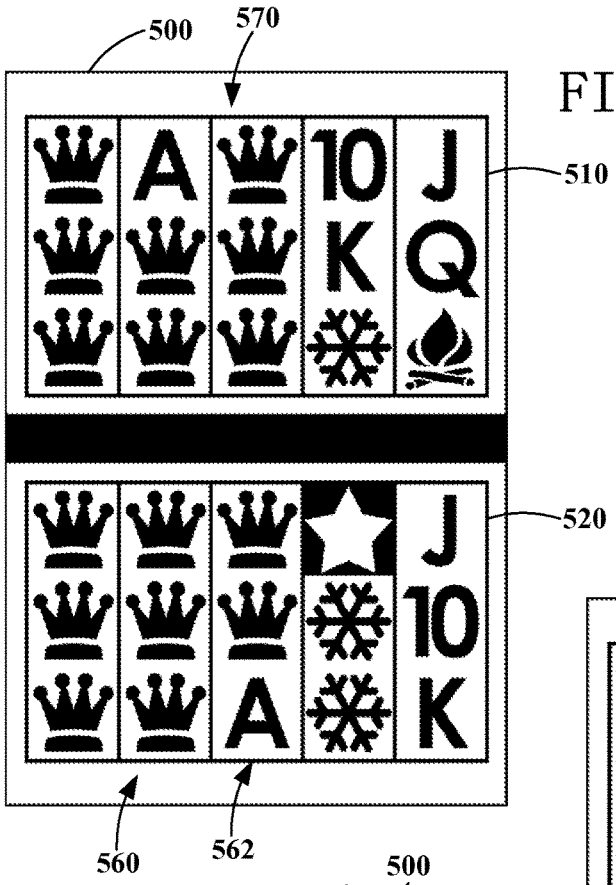
FIGS. 5A, 5B, and 5C are diagrams of a game display showing example game play methods according to embodiments of the invention.
Figure 5B:
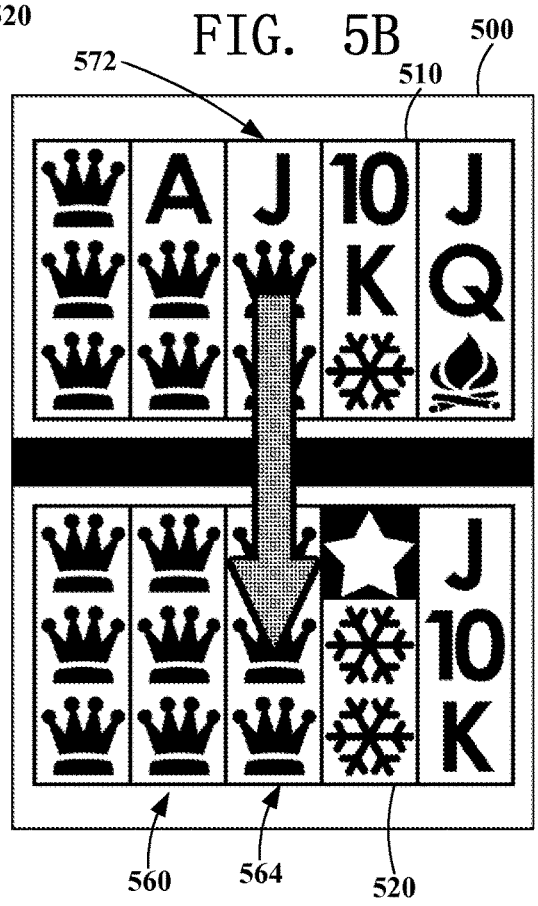
Figure 5C:
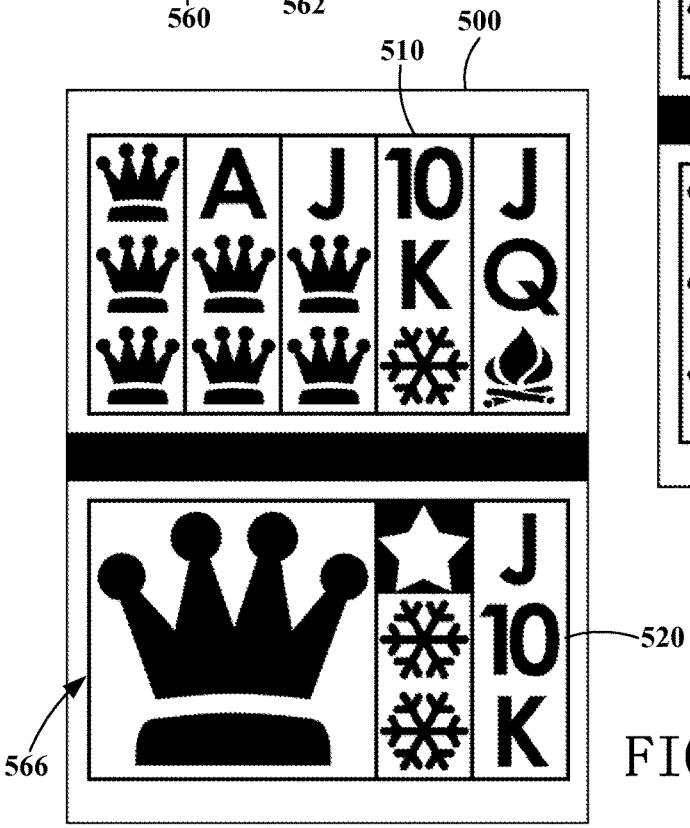

Referring to FIGS. 5A-5C, a game display 500 includes a primary game portion or display 520 and a secondary game portion or display 510. Here, the secondary game portion 510 is analyzed to determine if one or more of the additional symbols 570 in the secondary display would create or enhance a win 560 in the primary or main game 520. This addition symbol or symbols may be used in a substitution process, by nudging a reel down, or by otherwise manipulating the primary and secondary game displays 520, 510 to utilize the advantageous symbol in the secondary game display 510. In the embodiment shown in FIGS. 5A-5C, a reel 572 is nudged down to complete a 3×3 set of stacked "crown" symbols 564 in the primary game display 520. This set of stacked "crown" symbols 564 may then turn into a large block symbol 566 and provide associated awards to the player. In some embodiments, nudging or other substitution processes could continue until all like-symbols on the extended reels in the secondary display 510 are exhausted. Additionally, a multiplier (or other award) could be awarded based on the number of nudges that occur.

Although FIGS. 5A-5C illustrate this substitution process as a reel nudge, other embodiments may substitute one or more symbols from the secondary display 510 to the primary display 520. For example, referring to FIGS. 5A and 5C only, the crown 570 in the upper position of the third reel in the secondary display 510 may be substituted for the "Ace" or "A" symbol 562 in the primary display 520. In this example, the next symbol in the third reel replaces the substituted crown in the secondary display 510. However, in other embodiments, the symbols may switch positions (i.e., the "Ace" from the primary display 520 moves to position vacated by the substituting crown in the secondary display 510), or another symbol may randomly be chosen as a replacement symbol. In yet other embodiments, entire strings or combinations of symbols may be substituted from the secondary display 510 to the primary display 520. This substitution process may be triggered by various criteria. In one example, the substitution process is randomly activated, where the substitution is made if it improves the outcome on the primary display 520. In another example, the substitution process is triggered when a three-symbol combination in the secondary display 510 could improve an outcome in the primary display 520 (where the entire three-symbol combination may be substituted). In other examples, the triggering criteria for the substitution process may be based on symbol position, potential outcomes in the primary game, near misses, or other types of conditions related to the primary and/or secondary displays.

Figure 6A:
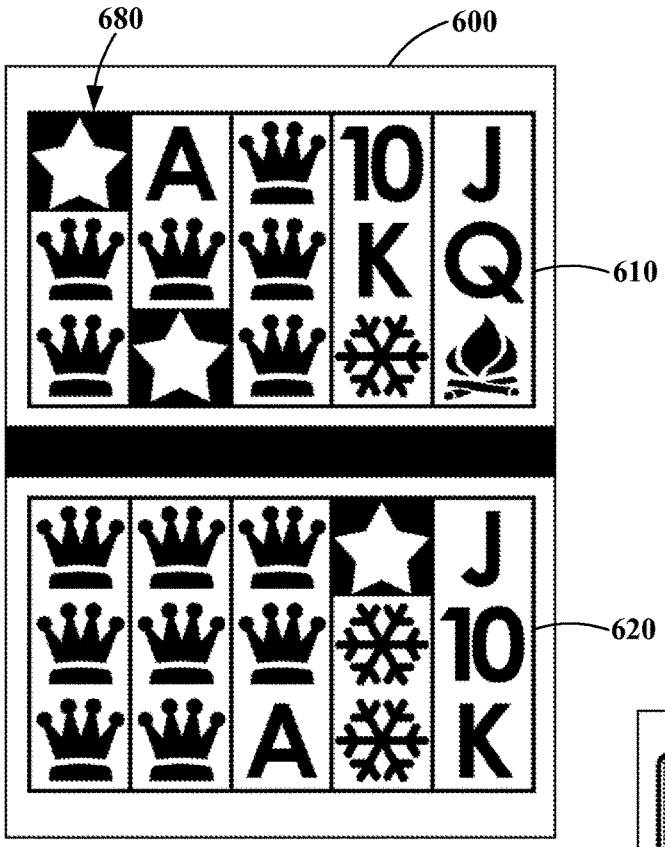
FIGS. 6A and 6B are diagrams of a game display showing example game play methods according to embodiments of the invention.
Figure 6B:
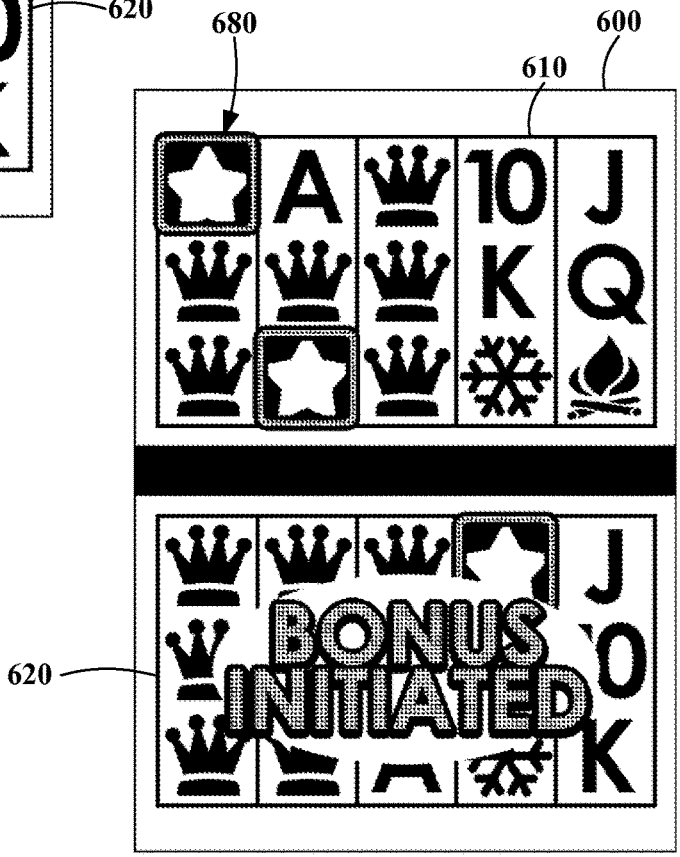

Referring to FIGS. 6A and 6B, a game display 600 includes a primary game portion or display 620 and a secondary game portion or display 610. Here, specific symbols 680 (bonus triggers, scatter symbols, etc.) present on the extended reels in the secondary display 610 may be evaluated along with the symbols in the primary or main game 620 to determine awards, triggered bonuses, or other game events. In some embodiments, this may increase the likelihood of a second screen bonus or other event occurring during game play.

Figure 7A:
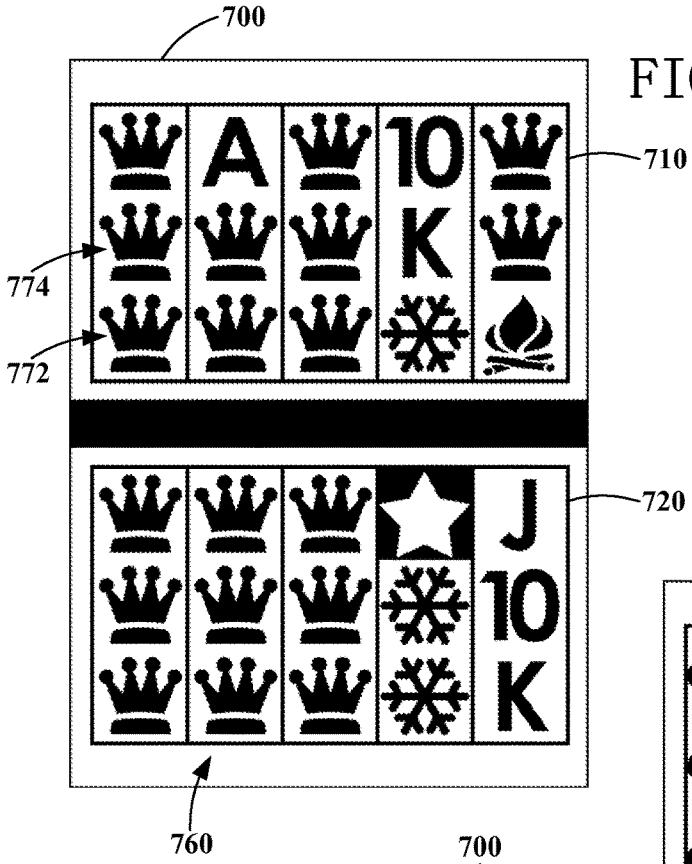
FIGS. 7A, 7B, and 7C are diagrams of a game display showing example game play methods according to embodiments of the invention.
Figure 7B:
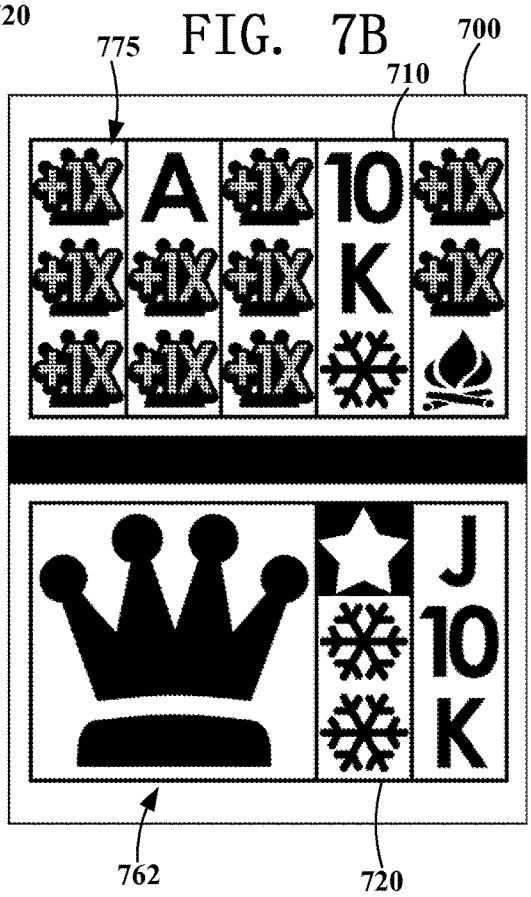
Figure 7C:
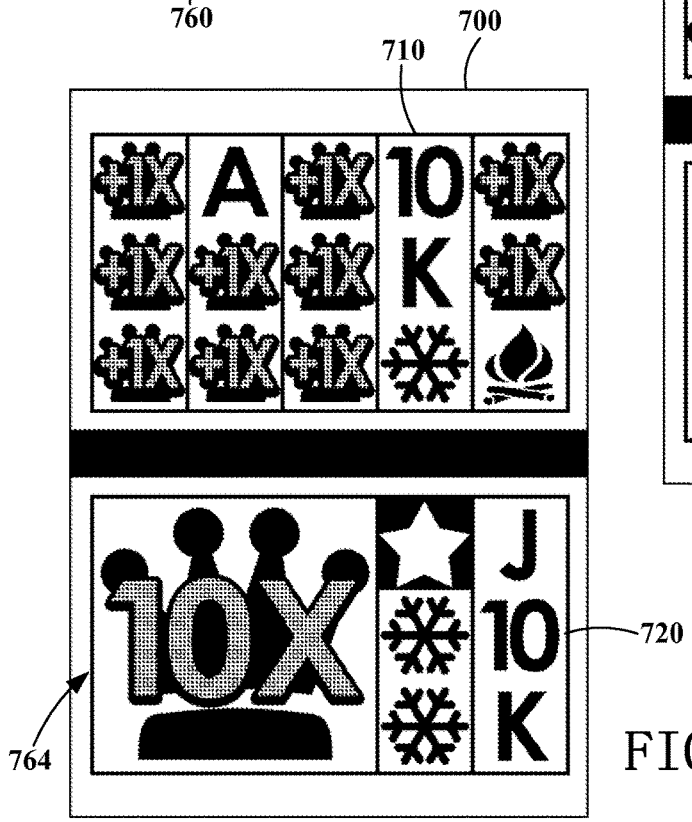

Referring to FIGS. 7A-7C, a game display 700 includes a primary game portion or display 720 and a secondary game portion or display 710. Here, each of the additional symbols 775 in the secondary display 710 that matches a paying symbol 760 in the primary or main game 720 contributes (in an additive or other fashion) toward a win multiplier or other award. In another similar embodiment, a block of symbols 762 in the primary or main game 720 may trigger a free game bonus, where matching symbols 775 in the secondary display 710 may add to the number of free games awarded.

For example, consider the symbol result that appears in FIG. 7A. The set of 3×3 stacked "crown" symbols 760 the primary display 720 of the main game triggers a free-spin bonus where five free games are awarded. In addition any three symbol combinations of related symbols ("crowns") in the secondary display 710 will add an additional awarded free game. Here, since there are two additional three symbol combinations of crowns that appear in the secondary display 772, 774, an additional two free games are awarded. Hence, a total of seven free games will be awarded. In other embodiments, various other methods of determining additional free games or other bonuses may be used.

In another example shown in FIG. 7B, each additional "crown" symbol 775 in the secondary display 710 is counted as another free game awarded. Thus, a total of 15 free games would be awarded: five from the bonus trigger 762 in the main game 720, and ten from the ten "crown" symbols 775 appearing in the secondary display 710.

These examples are not limiting as this concept covers all types of line pays, bonus triggers, and main game interactions with symbols appearing in one or more secondary displays. For example, the secondary symbols 775 in the secondary display 710 could trigger multipliers, expanded line wins, super symbol expanders (symbol expanding over at least a portion of an associated column and/or row), cascading or replacing of symbols that are eliminated from the main game display 720, nudges, locks and respins, free games with extended player areas or paylines, etc. Additionally, in free spin bonus games won, additional paylines may be used in the secondary display 710 to create additional win possibilities with each bonus or free spin.

In another example embodiment shown in FIG. 7C, each additional "crown" symbol in the secondary display 710 is counted and summed into a multiplier to be used with a triggering symbol combination 764 in the primary game display 720. As shown in FIG. 7C, the 10 additional "crown" symbols in the secondary game portion 710 creates a "10×" multiplier to be used to enhance awards won in the primary game 720.

As discussed above, the symbols in the one or more secondary displays 710 may be associated with the symbols on the main game display 720 (such as being part of the same reel strips), or, in other embodiments, may be independently derived from the symbols that appear in the main game display. Betting or wagering for these bonus features could be part of the main game wager, accomplished through a Bonus (side) Bet, activated when the Maximum Bet is played, or when all Lines/Ways are wagered.

Referring to FIGS. 8A-8F, a game display 800 includes a primary game portion or display 820 and a secondary game portion or display 810. Here, predefined symbols 815, 816 (e.g., "shaded-7" symbols in this embodiment) that land in the secondary display 810 may be randomly used to modify the game outcome in the primary game portion 820. In this embodiment, the predefined symbols 816, 817 landing in the secondary display 810 may randomly be used to create expanding symbols in the primary game portion 820. In other embodiments, predefined symbols in the secondary display 810 may always be used in a predetermined manner to modify the primary game portion. Additionally, the predefined symbols occurring in the secondary game display 810 may be used in various manners to modify the primary game portion 820. For example, the predefined symbols may replace a symbol in the primary game portion 820, may create a multiple or split symbol in the primary game portion, may change a matching (or other) symbol in the primary game portion to a wild symbol, or otherwise modify a portion of the primary game portion to enhance game play on the gaming device.

Figure 8A:
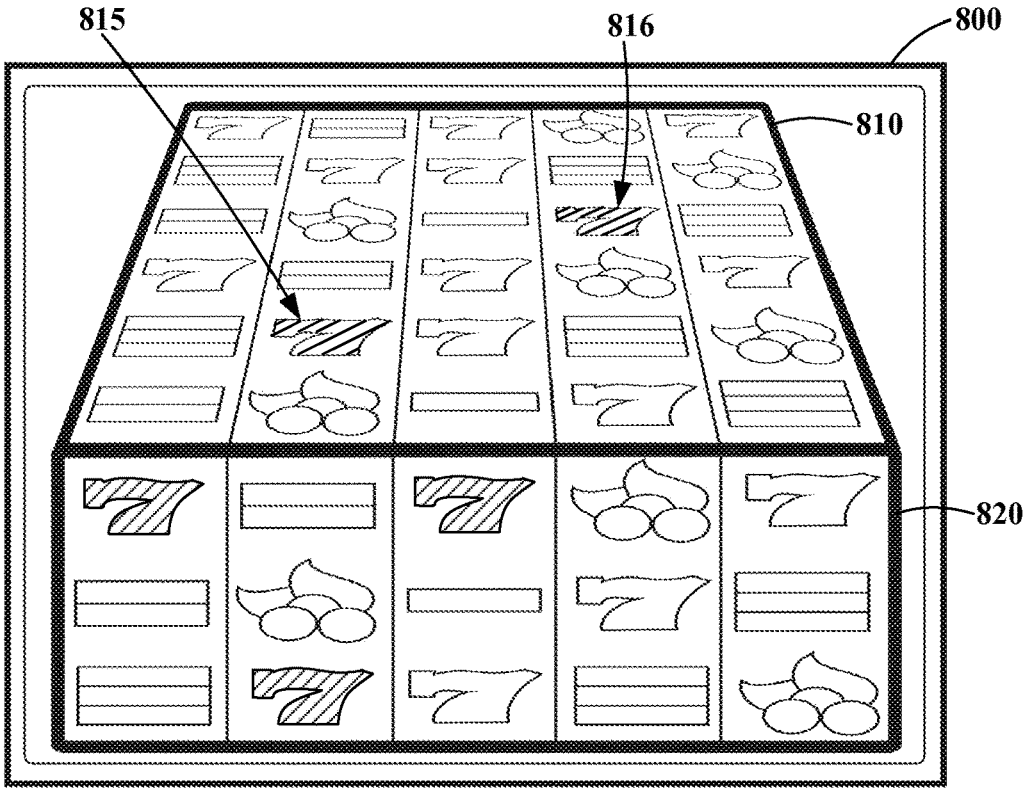
FIGS. 8A, 8B, 8C, 8D, 8E, and 8F are diagrams of a game display showing example game play methods according to embodiments of the invention.
Figure 8B:
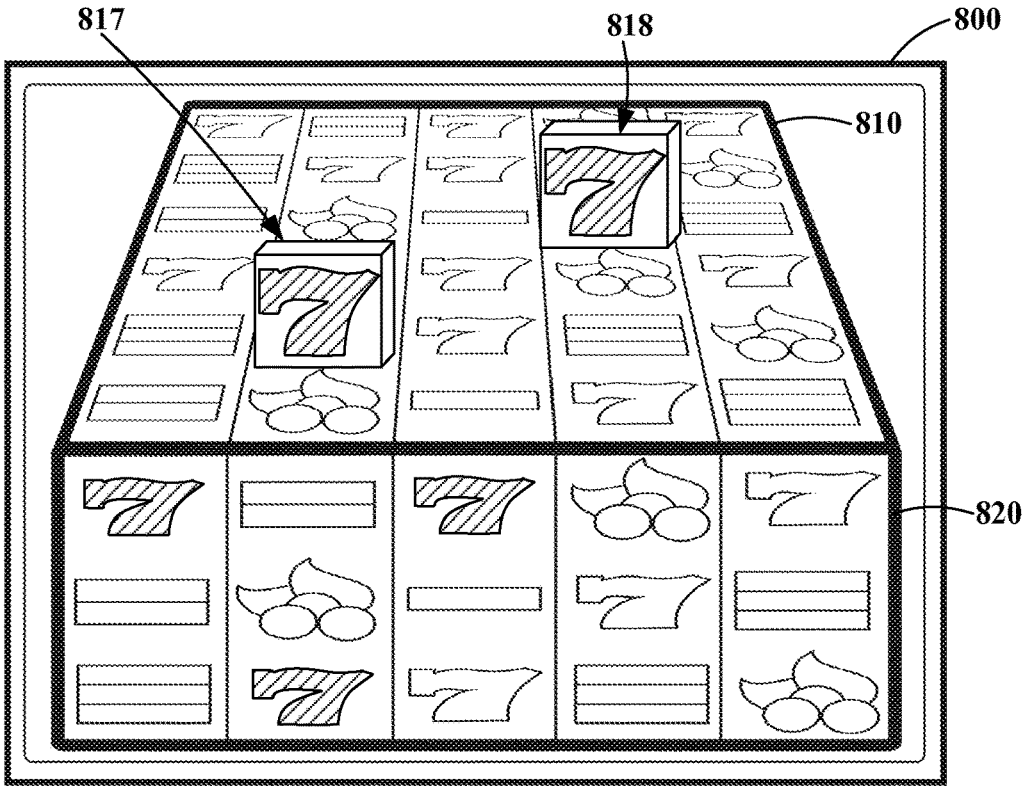
Figure 8C:
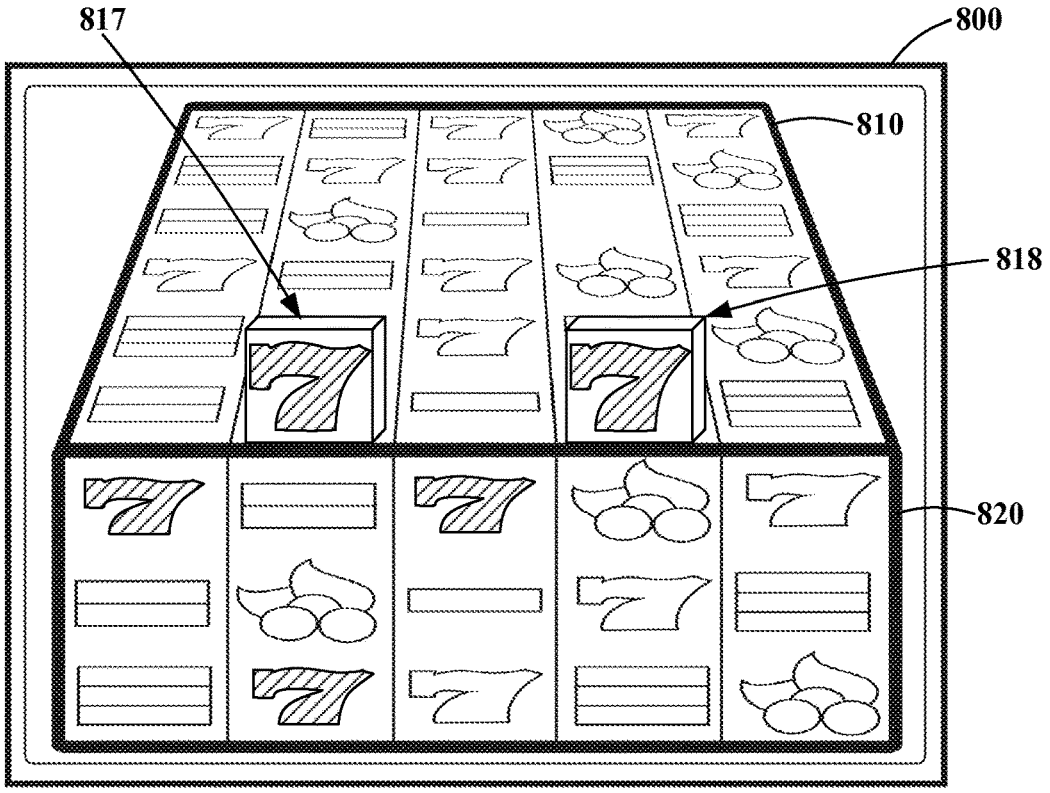
Figure 8D:
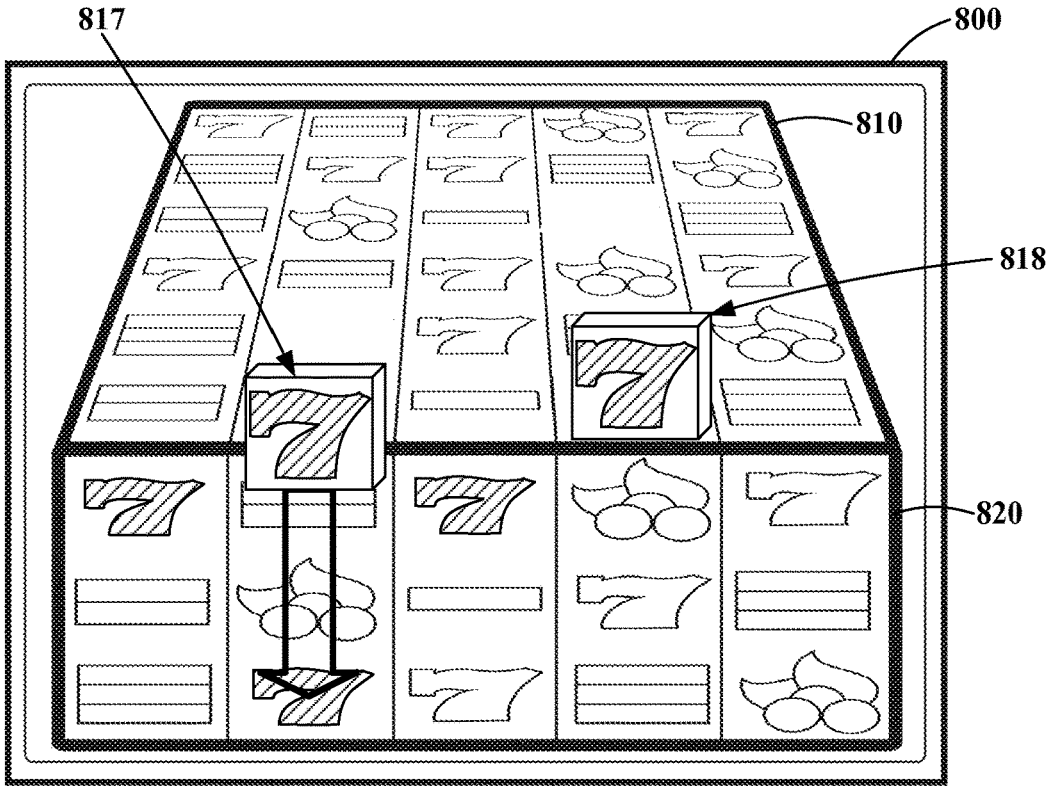
Figure 8E:
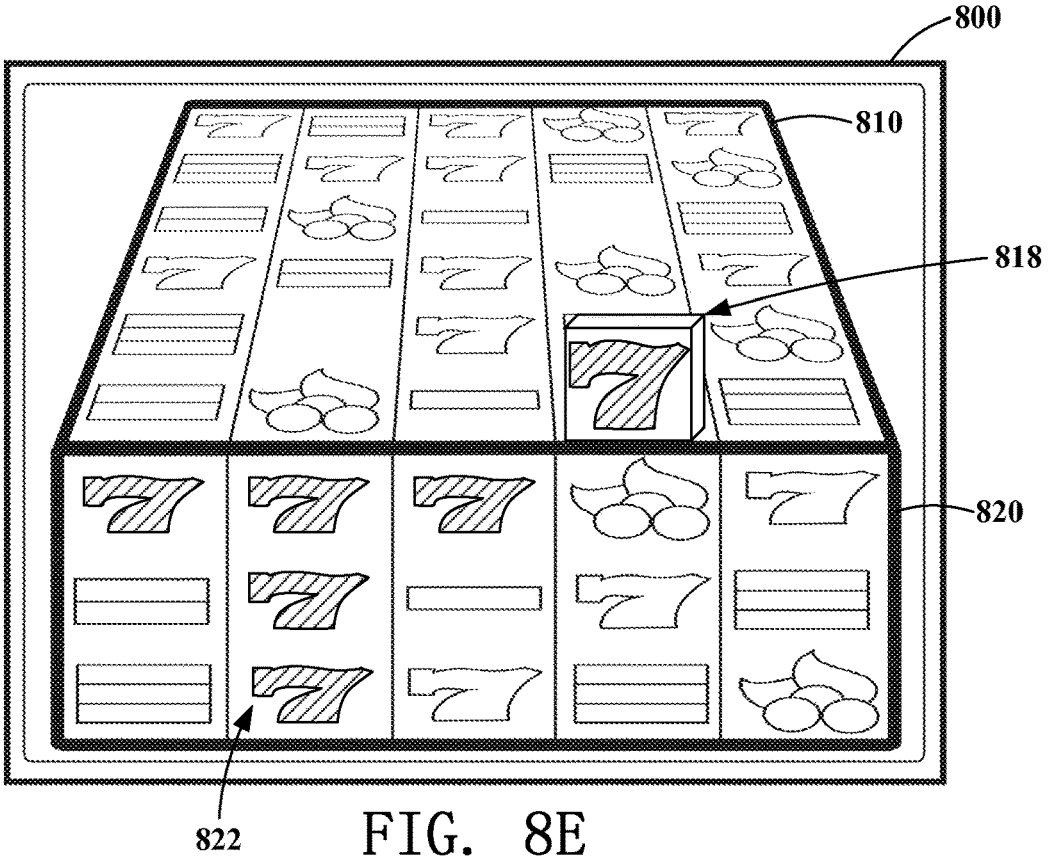
Figure 8F:
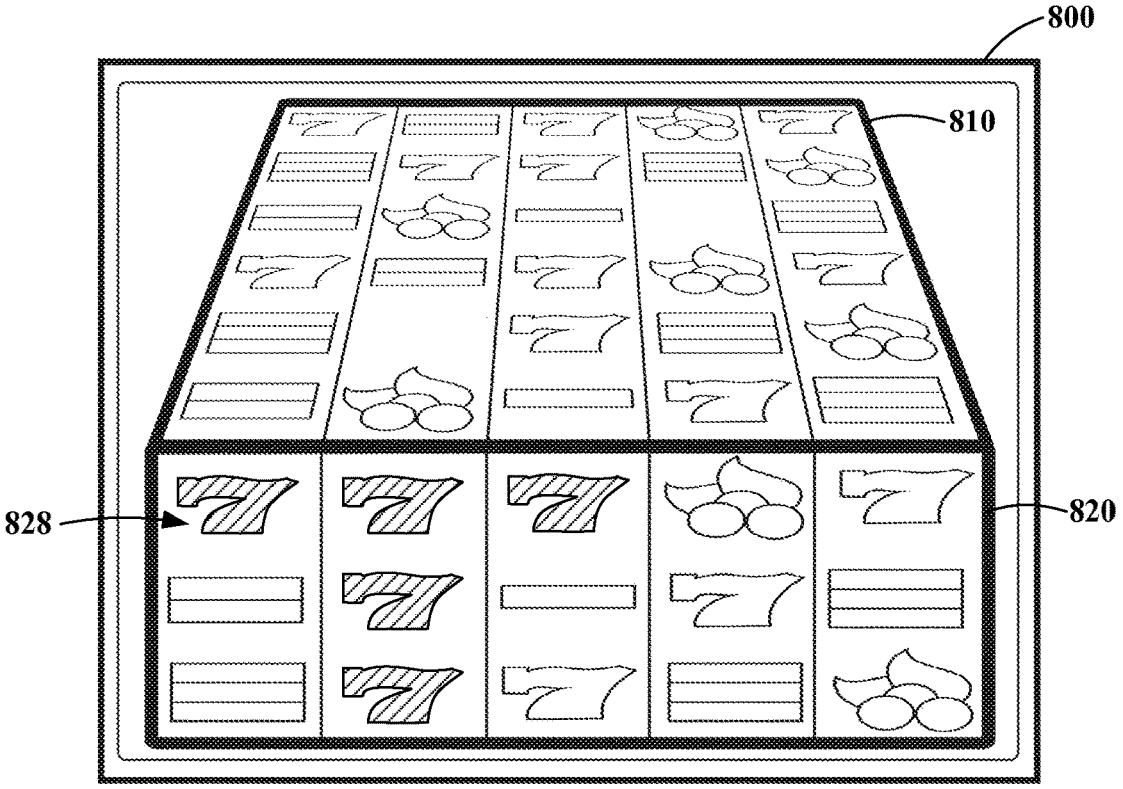

Returning to the illustrated embodiment, FIG. 8B shows the predefined symbols 815, 816 turning into mobile symbols 817, 818. In FIG. 8C, these mobile symbols are moved to the top edge of the primary game display 820. It is then randomly determined if the mobile symbols 817, 818 will fall and create an expanded symbol group on the corresponding game reel in the primary game portion 820. As shown in FIG. 8D, the mobile symbol 817 on the second game reel is randomly determined to drop over the second reel in the primary game portion 820. As shown in FIG. 8E, this results in an expanded "shaded-7" symbol group 822 being present on the second game reel in the primary game portion 820. The mobile game symbol 818 on the fourth reel, however, is randomly determined to not jump or drop. It may disappear or return to its previous location in the secondary display 810. The resulting primary game display is then evaluated for winning combinations of symbols as shown in FIG. 8F. Here, a 3-symbol pay of "shaded-7s" is now created in the primary game 820, and a corresponding award is presented.

Figure 9:
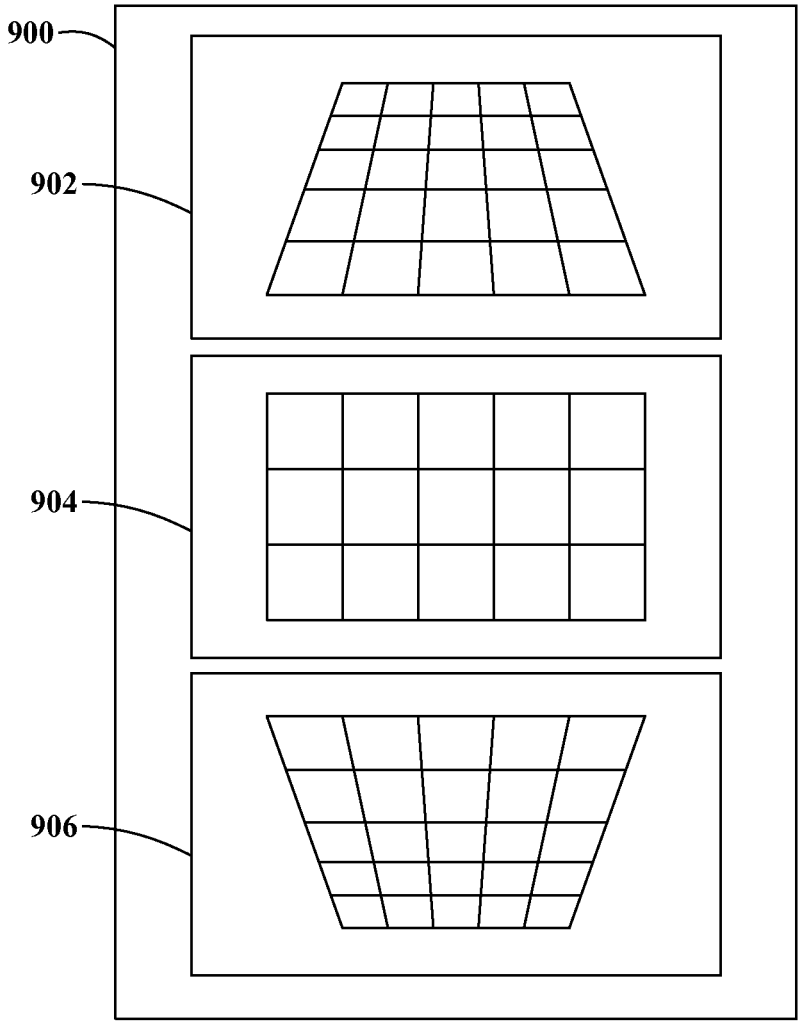
FIG. 9 is a diagram of example game displays of a gaming device according to embodiments of the invention.

FIG. 9 illustrates embodiments where three separate displays 902, 904, 906 are used in a game display 900. As discussed above, these displays 902, 904, 906 may be physically separate display devices, or may be three portions of a common display. Alternatively, two of the display areas may be included on a common display and the remaining display area may be shown on an independent display device. Returning to FIG. 9, a gaming display 900 includes a first display area 902, a second display area 904, and a third display area 906. For purposes of this embodiment, the first display area 902 shows portions of a reel strip that have not yet reached a main game area. The second display area 904 may be the main game areas where symbol combinations following paylines are evaluated against a paytable to determine if any prizes are to be awarded. The third display area 906 shows portions of the reel strip that have just passed through the main game area. The symbols in one or both of the first display area 902 and the third display area 906 may be used to trigger bonus events that may affect the game play in the main game area shown in the second display area 904.

By providing an additional display, this embodiment allows for an increase in the possible types of bonus events as well as showing the player symbols that just missed landing in the main game area of the second display area 904. In some embodiments, one type of bonus event may be associated with symbols appearing in the first display 902, while a second type of bonus event may be associated with symbols appearing in the third display 906. For example, the symbols in the first display 902 may be associated with a free spin bonus triggered in the second main game display 904, while symbols in the third display 906 may be associated with a multiplier for line wins in the main game, or a multiplier for use in a triggered free spins bonus. Numerous variations exist in how these display areas may be used to trigger or augment bonuses.

Figure 10A:
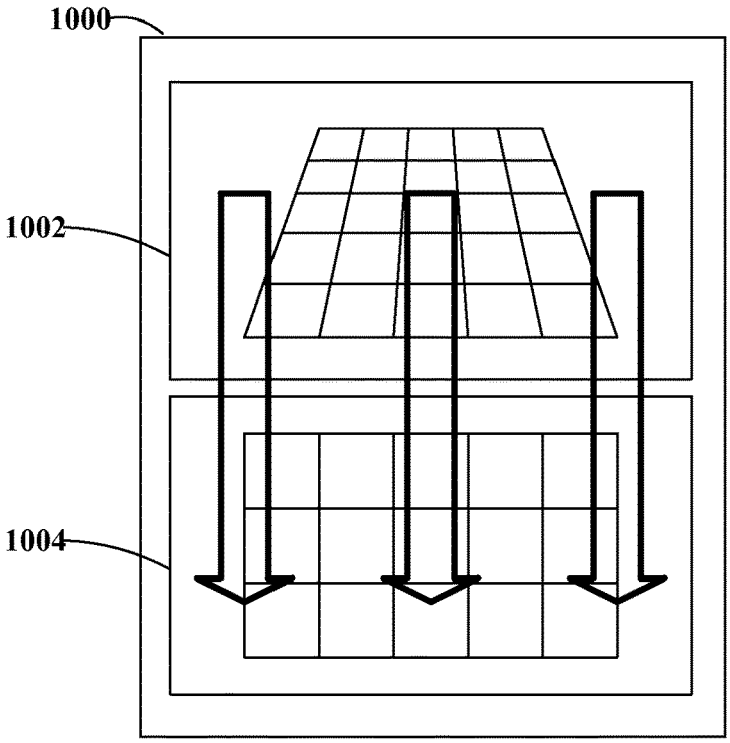
FIGS. 10A and 10B are diagrams of a game display showing example game play methods according to embodiments of the invention.
Figure 10B:
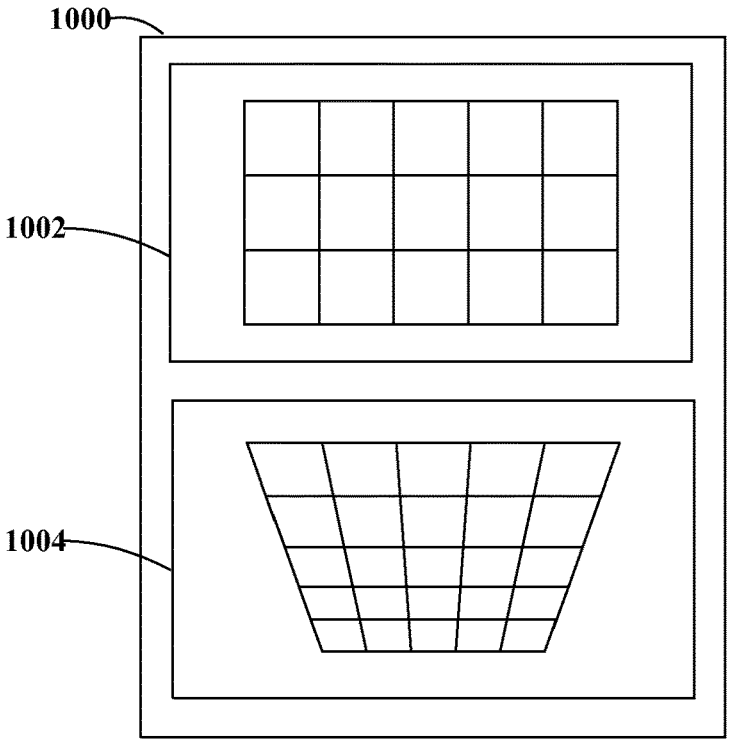

FIGS. 10A and 10B illustrate an embodiment that utilizes the symbols both above and below the symbols appearing in a main game display area similarly to the embodiment shown in FIG. 9, but using only two display areas. Here, the game may shift or scroll between the images shown in FIG. 10A and the images shown in FIG. 10B. That is, the gaming device 1000 may initially show the symbols of a main game area in a second display area 1004 and show the symbols following these main game area symbols in the first display area 1002, as shown in FIG. 10A. However, during the spin, and/or after the spin, the game scrolls the images on the screens so that, as shown in FIG. 10B, the main game display area is shown in first display area 1002 and the symbols preceding the ones shown in the main game display are shown in the second display area. In some embodiments, the game screens may scroll or oscillate between these two states (or utilizing additional states) until the reels stop spinning, or some other event occurs.

Figure 11:
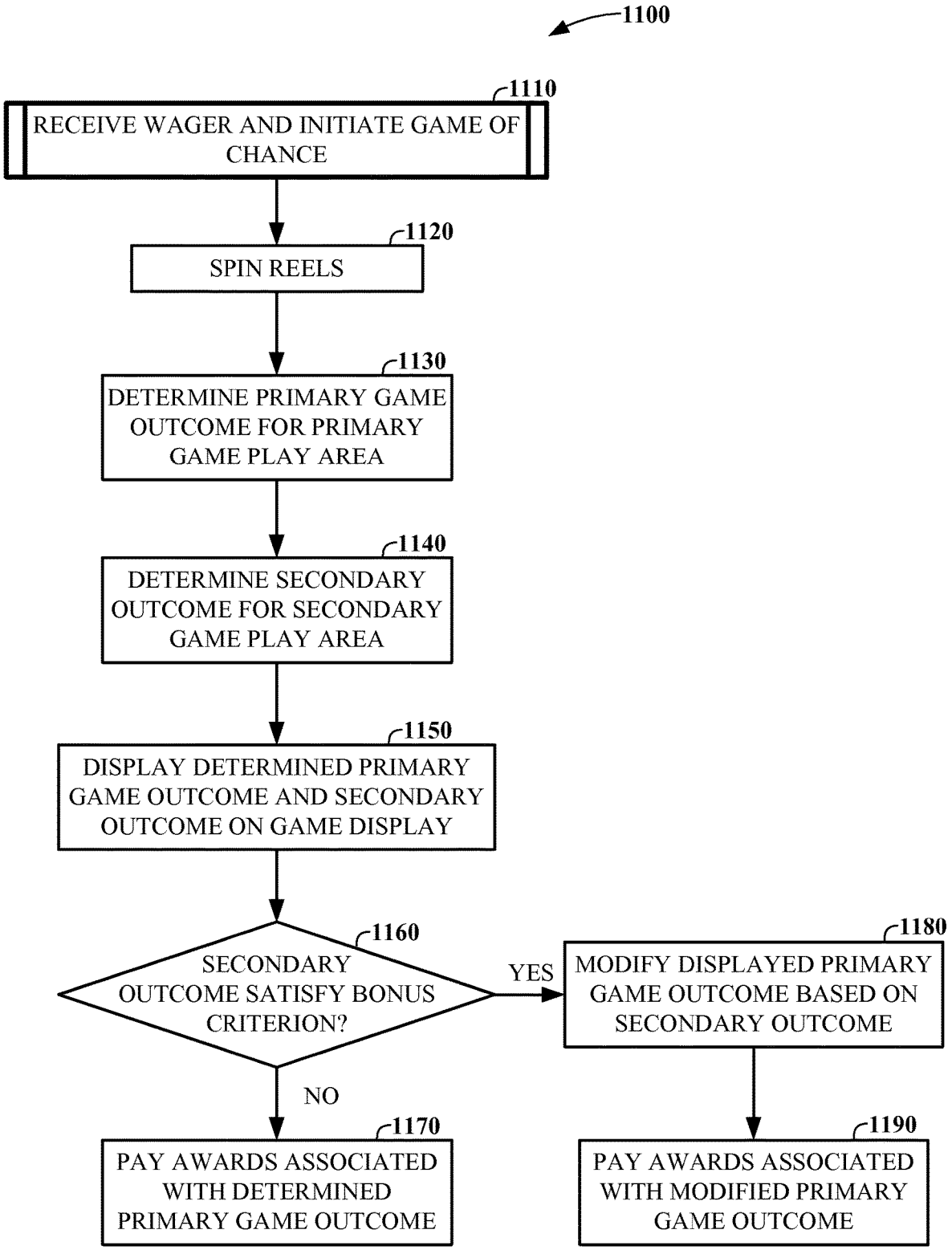
FIG. 11 is a flow diagram showing a method of utilizing extended displays of symbol indicia symbols on a gaming device according to embodiments of the invention.

FIG. 11 is a flow diagram showing a method of utilizing extended displays of symbol indicia symbols on a gaming device according to embodiments of the invention. Although various processes are shown in a particular order in this flow diagram, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device. Note that this example method is just one embodiment of how a game operation can be implemented. As discussed and shown above, many variations exist which may require additional, less, or different processes to complete.

Referring to FIG. 11, flow 1100 begins with process 1110 where a signal is received indicating that a wager has been placed and a new game have been initiated on a gaming device. In process 1120, the game reels may be spun to visually show a spinning or shuffling of game symbols in primary and secondary game portions. Processes 1130 and 1140 are also completed after the signal in process 1110 has been received. In process 1130, a primary game outcome for the primary game portion is determined. In process 1140, a secondary game outcome for the secondary game portion is determined. As described above, processes 1130 and 1140 may be interrelated when continuous predefined reel strips spin or travel through both the primary game portion and secondary game portion. In other embodiments, processes 1130 and 1140 may be substantially independent. For example, where each position of the game grids in the primary game portion and secondary game portion has an independent reel strip, the primary game outcome and secondary game outcome may not be associated with one another.

In process 1150, the determined primary game outcome and determined secondary outcome are displayed on the game display of the gaming device. In process 1160, it is determined whether the secondary outcome satisfies a bonus criterion or condition. As described above, is some embodiments the determination executed in process 1160 includes analyzing both the secondary outcome and primary game outcome to determine if a bonus criterion or condition is satisfied. For example, the embodiment shown in FIGS. 6A and 6B and described above takes into account bonus symbols that appear in both the displayed primary game outcome and the displayed secondary outcome. In other embodiments, only the secondary outcome is analyzed to determine if a bonus criterion or condition is met. For example, the embodiment shown in FIGS. 8A-8F and described above only takes into account the displayed secondary outcome in determining is a bonus criterion or condition is met.

If it is determined in process 1160 that a bonus criterion is not satisfied, flow 1100 proceeds to process 1170 where awards associated with the determined primary game outcome are paid. On the other hand, if it is determined in process 1160 that a bonus criterion is satisfied, flow 1100 proceeds instead to process 1180 where the displayed primary game outcome is modified based at least in part on the secondary outcome. As described above, there are many different embodiments of how this modification process in process 1180 can be implemented. For example, symbol combinations or outcomes in the displayed secondary outcome may provide a multiplier or other modifier for the displayed primary game outcomes. In other examples, special symbols in the displayed secondary outcome may be counted or otherwise activated to generate free spin bonus games, to provide a multiplier or other modifier, to nudge, shift, or respin one or more of the reels thereby changing the outcome in the primary game, or be used in conjunction with outcomes in the primary game to win special awards such as bonus or progressive awards. Numerous other modification variations are also possible in other embodiments. After the modification is carried out in process 1180, flow 1100 proceeds to process 1190 where awards are paid for the modified primary game outcome. In addition, in some embodiments, process 1190 may also pay awards that are associated with the symbol combinations presented in the displayed secondary outcome.

Figure 12:
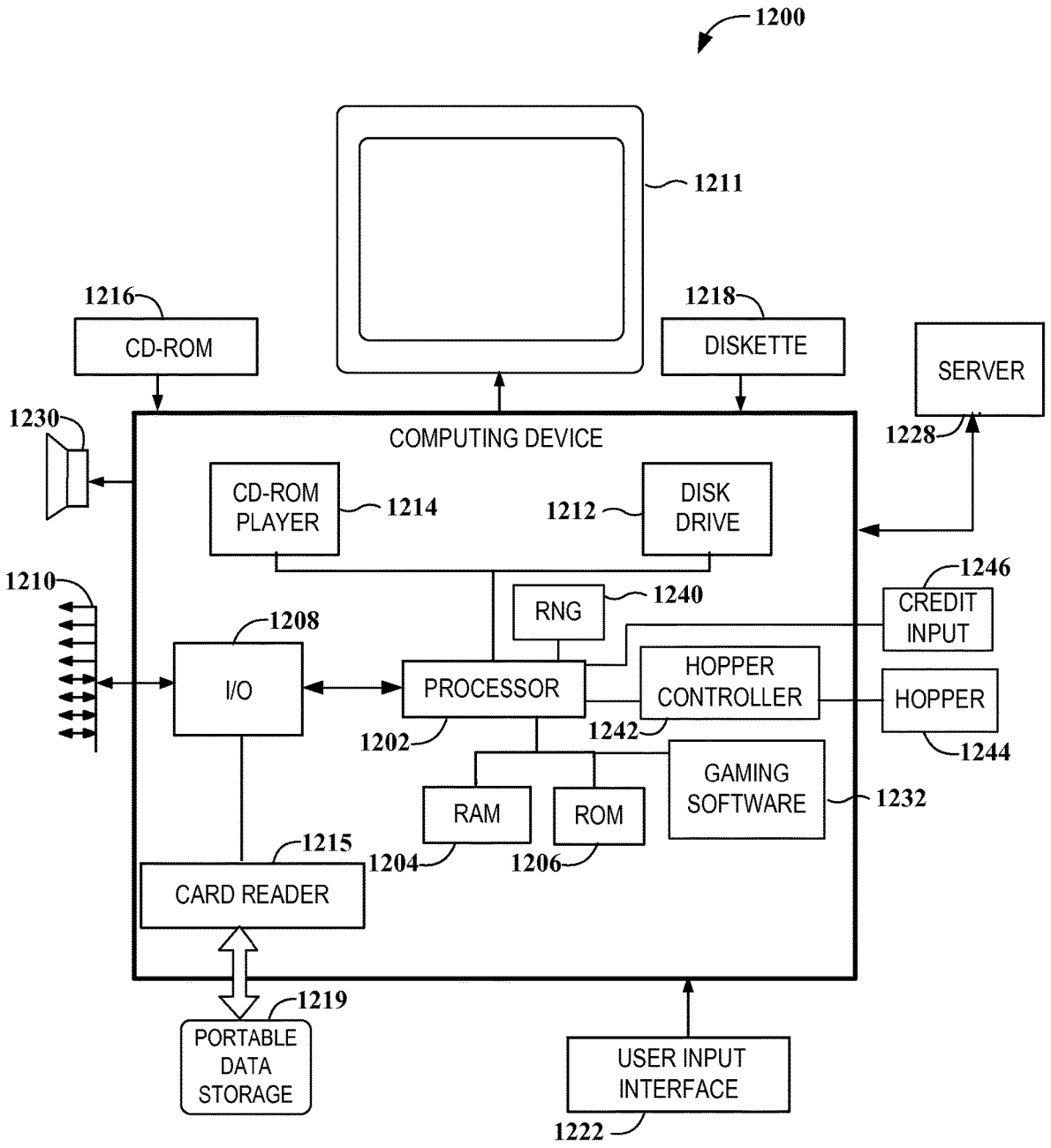
FIG. 12 is a block diagram illustrating a computing arrangement according to embodiments of the invention.

As may now be readily understood, one or more devices may be programmed to play various embodiments of the invention. The present invention may be implemented as a casino gaming machine or other special purpose gaming kiosk as described hereinabove, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 12.

Hardware, firmware, software or a combination thereof may be used to perform the various gaming functions, display presentations and operations described herein. The functional modules used in connection with the invention may reside in a gaming machine having a body structure as described, or may alternatively reside on a stand-alone or networked computer. The computing structure 1200 of FIG. 12 is an example computing structure that can be used in connection with such electronic gaming machines, computers, or other computer-implemented devices to carry out operations of the present invention.

The example computing arrangement 1200 suitable for performing the gaming functions in accordance with the present invention typically includes a central processor (CPU) 1202 coupled to random access memory (RAM) 1204 and some variation of read-only memory (ROM) 1206. The ROM 1206 may also represent other types of storage media to store programs, such as programmable ROM (PROM), erasable PROM (EPROM), etc. The processor 1202 may communicate with other internal and external components through input/output (I/O) circuitry 1208 and bussing 1210, to provide control signals, communication signals, and the like.

The computing arrangement 1200 may also include one or more data storage devices, including hard and floppy disk drives 1212, CD-ROM drives 1214, card reader 1215, and other hardware capable of reading and/or storing information such as DVD, etc. In one embodiment, software for carrying out the operations in accordance with the present invention may be stored and distributed on a CD-ROM 1216, diskette 1218, access card 1219, or other form of computer readable media capable of portably storing information. These storage media may be inserted into, and read by, devices such as the CD-ROM drive 1214, the disk drive 1212, card reader 1215, etc. The software may also be transmitted to the computing arrangement 1200 via data signals, such as being downloaded electronically via a network, such as the Internet. Further, as previously described, the software for carrying out the functions associated with the present invention may alternatively be stored in internal memory/storage of the computing device 1200, such as in the ROM 1206.

The computing arrangement 1200 is coupled to the display 1211, which represents a display on which the gaming activities in accordance with the invention are presented. The display 1211 represents the "presentation" of the video information in accordance with the invention, and may be any type of known display or presentation screen, such as liquid crystal displays, plasma displays, cathode ray tubes (CRT), digital light processing (DLP) displays, liquid crystal on silicon (LCOS) displays, etc.

Where the computing device 1200 represents a standalone or networked computer, the display 1211 may represent a standard computer terminal or display capable of displaying multiple windows, frames, etc. Where the computing device is embedded within an electronic gaming machine, the display 1211 corresponds to the display screen of the gaming machine/kiosk. A user input interface 1222 such as a mouse, keyboard/keypad, microphone, touch pad, trackball, joystick, touch screen, voice-recognition system, etc. may be provided. The display 1211 may also act as a user input device, e.g., where the display 1211 is a touch-screen device.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs as known in the art may be implemented using hardware, software operable in connection with the processor 1202, or some combination of hardware and software. The present invention is operable using any known RNG, and may be integrally programmed as part of the processor 1202 operation, or alternatively may be a separate RNG controller 1240.

The computing arrangement 1200 may be connected to other computing devices or gaming machines, such as via a network. The computing arrangement 1200 may be connected to a network server 1228 in an intranet or local network configuration. The computer may further be part of a larger network configuration as in a global area network (GAN) such as the Internet. In such a case, the computer may have access to one or more web servers via the Internet. In other arrangements, the computing arrangement 1200 may be configured as an Internet server and software for carrying out the operations in accordance with the present invention may interact with the player via one or more networks.

Other components directed to gaming machine implementations include manners of gaming participant payment, and gaming machine payout. For example, a gaming machine including the computing arrangement 1200 may also include a hopper controller 1242 to determine the amount of payout to be provided to the participant. The hopper controller may be integrally implemented with the processor 1202, or alternatively as a separate hopper controller 1242. A hopper 1244 may also be provided in gaming machine embodiments, where the hopper serves as the mechanism holding the coins/tokens of the machine. The wager input module 1246 represents any mechanism for accepting coins, tokens, coupons, bills, electronic fund transfer (EFT), tickets, credit cards, smart cards, membership cards, etc., for which a participant inputs a wager amount. It will be appreciated that the primary gaming software 1232 may be able to control payouts via the hopper 1244 and controller 1242 for independently determined payout events.

Among other functions, the computing arrangement 1200 provides an interactive experience to players via input interface 1222 and output devices, such as the display 1211, speaker 1230, etc. These experiences are generally controlled by gaming software 1232 that controls a primary gaming activity of the computing arrangement 1200. The gaming software 1232 may be temporarily loaded into RAM 1204, and may be stored locally using any combination of ROM 1206, drives 1212, media player 1214, or other computer-readable storage media known in the art. The primary gaming software 1232 may also be accessed remotely, such as via the server 1228 or the Internet.

The primary gaming software 1232 in the computing arrangement 1200 is shown here as an application software module. According to embodiments of the present invention, this software 1232 provides a slot game or similar game of chance as described hereinabove. For example, the software 1232 may present, by way of the display 1211, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 1232 may include instructions to provide other functionality as known in the art and described herein, such as shown and described above regarding FIGS. 1-11.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A gaming device comprising:

a body structure;

a first video display device housed in the body structure, the first video display for displaying a primary game grid;

a second video display device housed it the body structure above the first video display device, the second video display for displaying a secondary game grid;

a memory device enclosed in the body structure, the memory device storing executable instructions, data associated with a first game reel having a first plurality of symbols, data associated with a second game reel having a second plurality of symbols, and data associated with a third game reel having a third plurality of symbols;

a processor enclosed in the body structure, the processor arranged to execute the instructions stored in the memory to:

cause the first game reel, second name reel, and third game reel to visually spin, where at least some of the first plurality of symbols, at least some of the second plurality of symbols, and at least some of the third plurality of symbols pass through the secondary game grid followed by passing through the primary game grid;

cause the first game reel, second game reel, and third game reel to cease spinning, where a first portion of the first plurality of symbols appear in the secondary game grid, a second portion of the first plurality of symbols appear in the primary game grid, a first portion of the second plurality of symbols appear in the secondary game grid, a second portion of the second plurality of symbols appear in the primary game grid, a first portion of the d plurality of symbols appear in the secondary game grid, and a second portion of the third plurality of symbols appear in the primary game grid;

evaluate the first portions of the first, second, and third plurality of symbols respectively shown in secondary game grid to determine if a bonus event is triggered;

execute the bonus event when it is determined that the bonus event is triggered, wherein an outcome of the bonus event modifies a first aspect of an evaluation of the primary game grid independently of any modification of a second aspect of the second game grid; and evaluate, based on the first aspect, the second portions of the first, second, and third plurality of symbols respectively shown in the primary game grid to determine awards associated with winning symbols combinations appearing in the primary game grid.

2. The gaming device of claim 1, wherein the processor is arranged to execute the instructions stored in the memory to execute the bonus event by performing process steps including:

counting a number of predefined symbols shown in the secondary game grid; and applying a multiplier associated with the counted number of predefined symbols shown in the secondary game grid to the determined awards associated with the winning symbol combinations appearing in the primary game grid.

3. The gaming device of claim 1, wherein the processor is arranged to execute the instructions stored in the memory to execute the bonus event by performing process steps including:

determining which of the first, second, or third game reels may be displaced to move at least one of the first portions of the first, second, and third plurality of symbols respectively shown in the secondary game grid to the primary game grid to provide optimum winning symbol combinations in the primary game grid; and displacing the determined one of the first, second, or third game reels to provide the optimum winning symbol combinations in the primary game grid.

4. The gaming device of claim 1, wherein the processor is arranged to execute the instructions stored in the memory to execute the bonus event by performing process steps including:

counting a first number of predetermined symbol combinations present in the secondary game grid; and providing a second number of bonus spins with the first, second, and third game reels, the second number of bonus spins based at least in part on the first number of determined symbol combinations present in the secondary game grid, wherein the primary game grid is evaluated for winning symbol combinations after each of the second number of bonus spins.

5. The gaming device of claim 4, wherein the processor is arranged to execute the instructions stored in the memory to execute the bonus event by further performing process steps including:

evaluating the secondary game grid for winning symbol combinations after each of the second number of bonus spins.

6. The gaming device of claim 1, wherein the processor is arranged to execute the instructions stored in the memory to execute the bonus event by performing process steps including:

determining if one or more symbol combinations in the secondary game grid match a symbol combination in the primary game grid; and providing a bonus award based on the determination of symbols combinations in the secondary grid matching a symbol combination in the primary game grid.

7. The gaming device of claim 6, wherein the processor is arranged to execute the instructions stored in the memory to execute the bonus event by further performing process steps wherein the provided bonus award is a progressive award.

8. The gaming device of claim 6, wherein the processor is arranged to execute the instructions stored in the memory to execute the bonus event by further performing process steps wherein the provided bonus award is a multiplier for multiplying the determined awards associated with the winning symbol combinations appearing in the primary game grid.

9. The gaming device of claim 1, wherein the processor is arranged to execute the instructions stored in the memory to determine if a bonus event is triggered by further performing process steps including evaluating the second portions of the first, second, and third plurality of symbols respectively shown in the primary game grid in addition to evaluating the first portions of the first, second, and third plurality of symbols respectively shown in the secondary game grid.

* * * * *